United States Patent [19]

Elston

[11] Patent Number: 4,678,125

[45] Date of Patent: Jul. 7, 1987

[54] NOZZLE

[75] Inventor: Thomas P. Elston, Randburg, South Africa

[73] Assignee: G S I Holdings (Proprietary) Limited, Transvaal, South Africa

[21] Appl. No.: 764,938

[22] Filed: Aug. 12, 1985

[30] Foreign Application Priority Data

Aug. 13, 1984 [ZA] South Africa ..... 84/6260

[51] Int. Cl.[4] ..... B05B 3/14; B05B 7/04; B05B 1/14; B05B 1/00

[52] U.S. Cl. ..... 239/589.1; 239/433; 239/550; 239/600

[58] Field of Search ..... 239/102.1, 433, 434, 239/566, 589.1, 550, 600

[56] References Cited

U.S. PATENT DOCUMENTS

| | | | |
|---|---|---|---|
| 1,017,533 | 2/1912 | Goodlett | 239/550 X |
| 1,940,111 | 12/1933 | Austin | 239/433 X |
| 2,831,728 | 4/1958 | Notz | 239/151 |
| 3,232,267 | 2/1966 | Hughes | 239/102 X |
| 3,240,254 | 3/1966 | Hughes | 239/102 X |
| 4,553,702 | 11/1985 | Coffee et al. | 239/690 |

*Primary Examiner*—Andres Kashnikow
*Assistant Examiner*—Patrick N. Burkhart
*Attorney, Agent, or Firm*—Lyon & Lyon

[57] ABSTRACT

A nozzle unit comprising a frusto-conical nozzle having a transverse flat end face, an outlet passage formed in this flat end face, an inner conduit member which in use is connected to a source of air under pressure, a water conduit which in use is connected to a source of water under pressure, and a mixing chamber in which the water and air is mixed and from which the mixture passes to be discharged through the outlet passage. The nozzle unit further has a concave cylindrical cap which is carried by rigid carrier means which is integral with the nozzle and into which the water/air mixture is discharged, the water being there broken down into very small droplets. The mixing chamber has a passage therethrough in the form of a venturi and inlet bores from the exterior of the chamber to just downstream of the venturi throat. In use, air passes through the venturi throat and the water is drawn in through the bores to the interior of the venturi throat and is there mixed with and entrained in the air.

11 Claims, 5 Drawing Figures

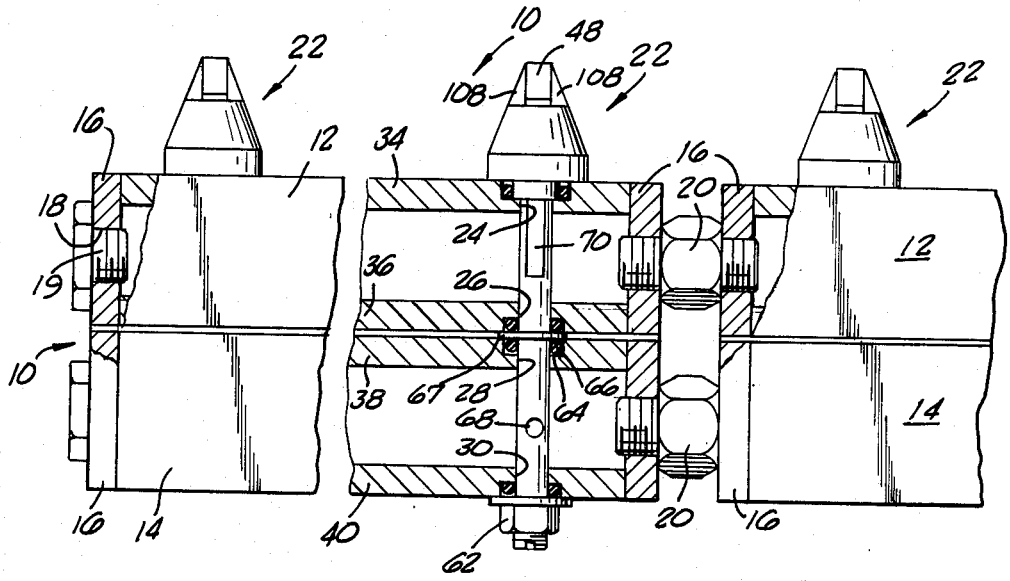
FIG. 1.
FIG. 2.
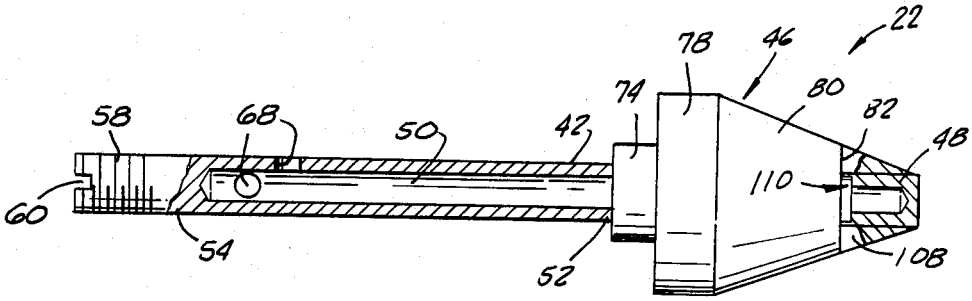
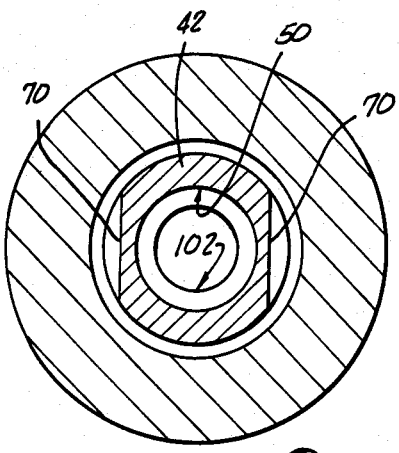
FIG. 4.
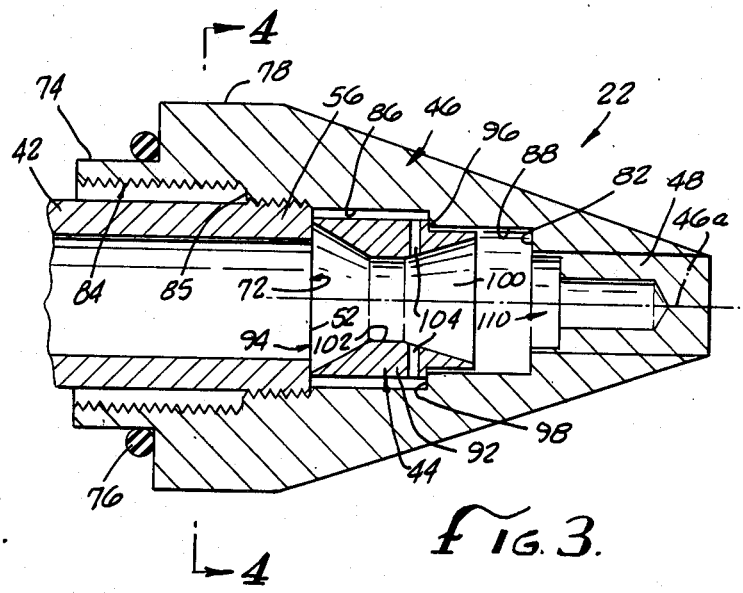
FIG. 3.

NOZZLE

This invention relates to spray nozzles of the kind which are provided to atomise a liquid medium.

In a known nozzle, there is provided a cap into which is received a stream of liquid entrained in a jet of air, the cap being spaced from the end of a nozzle and being secured thereto by a pair of wires or rod members that are brazed or welded to the sides of the cap and are secured to the nozzle either by being welded or brazed or being clipped thereto.

In one known nozzle unit for atomising fuel (South African Pat. No. 64/0769), the cap is formed integrally with the nozzle. In this nozzle unit, the fuel is mixed with an air stream outside the nozzle in the space between the end of the air conduit and the cap.

According to one aspect of the present invention there is provided a nozzle unit comprising a frusto-conical nozzle having a transverse flat end face, an outlet passage formed in this flat end face, an inner conduit member which in use is connected to a source of water under pressure, an air conduit which in use is connected to a source of pneumatic pressure, and a mixing chamber in which the water and air is mixed and from which the mixture passes to be discharged through the outlet passage; and a concave cylindrical cap which is carried by carrier means secured to the nozzle and into which the water/air mixture is discharged, the water being there broken down into very small droplets: wherein the mixing chamber has a passage therethrough in the form of a venturi through which the air in use passes, and inlet bores from the exterior of the chamber to a low pressure section of the passage, the water in use being drawn through such bores to the interior of the said low pressure section of the passage.

Preferably the mouth of the cap is located close to end face, being preferably spaced therefrom by no more than and preferably less than one half of the diameter of the throat of the venturi. The outer diameter of the cap is preferably less than the diameter of the passage. The body of the cap and the carrier means are preferably formed integrally with the nozzle and preferably the base of the cap is also integral with the body of the cap. However for the purposes of construction, the cap may have a through bore and the base welded thereto.

The conduit means may be threaded into the nozzle and the air conduit passes alongside the conduit means in a flow path constituted by a flat on the side of the conduit means. Preferably the mixing chamber has a venturi throat and through which the water passes and inlet bores into which the air passes to be introduced into the throat.

According to another aspect of the invention there is provided a nozzle arrangement comprising a pair of headers and at least one and preferably two nozzle units as set out above carried thereby preferably being located at the ends of one of the headers, the headers being connectable respectively to sources of water and pneumatic pressure and being connected respectively to the inner and air conduits. The headers are preferably capable of being connected to similar headers to build up a nozzle system of desired length.

Two embodiments of the invention will now be described by way of example with reference to the accompanying drawings.

In the drawings:

FIG. 1 is a side view, partially in section, of a nozzle arrangement of the invention, FIG. 2 is a detail, partially in section, through the nozzle unit of the invention, FIG. 3 is an enlarged detail section through the nozzle, and FIG. 4 is a section on line 4—4 of FIG. 3, and FIG. 5 is a section through a much larger nozzle of the invention.

DESCRIPTION OF THE PREFERRED EMBODIMENT.

Figure 5:
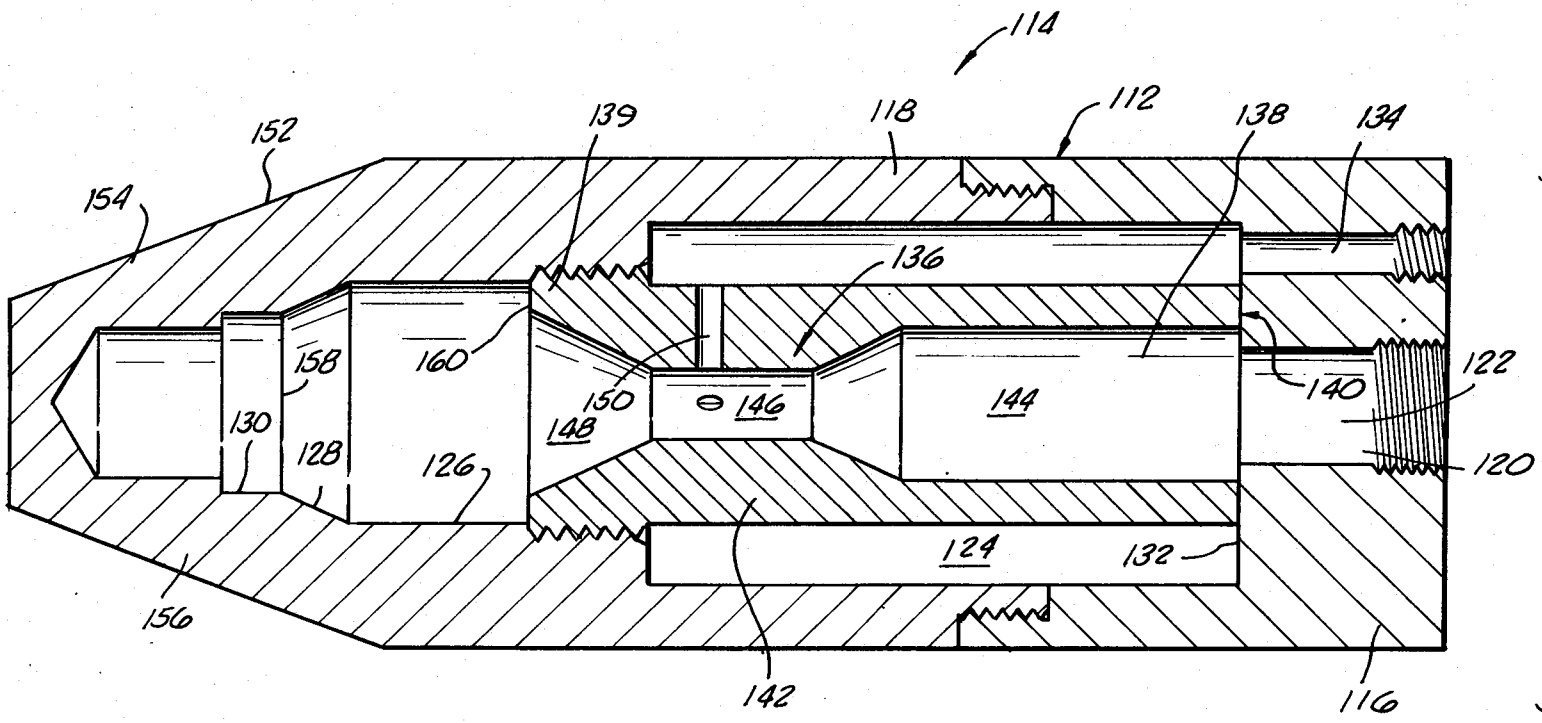

Referring now to the drawings, there is shown a nozzle arrangement 10 comprising a number of pairs of hollow, relatively thick walled, square section headers 12 and 14 in side by side contiguous relationship, the pairs being arranged end to end as will become apparent. The headers 12 and 14 have end walls 16 at each end and threaded bores 18 are provided in such end walls 16. The first headers 12 and 14 of the set are connected respectively to sources of water and pneumatic pressure (not shown) through the threaded bores 18. The adjacent pairs of headers are connected together so as to be able to build up a nozzle system of desired length. Plugs 19 are inserted into the bores 18 of the remote end walls of the last headers of the set. The adjacent headers are connected by nipples or unions 20 inserted into the bores 18 of adjacent headers.

THE NOZZLE UNITS 22

Two nozzle units 22 are carried by the headers 12 and 14 at the ends thereof in a manner that will be described. Each nozzle unit 19 passes through four registering bores 24, 26, 28 and 30 in parallel walls 34, 36, 38 and 40 of the headers.

Each nozzle unit 22 (as best shown in FIGS. 2 and 3) comprises an inner member 42, a mixing chamber 44 and a nozzle 46 that carries a cap 48.

THE INNER MEMBER 42 (FIGS. 2, 3 and 4)

The inner member 42 has an internal blind conduit 50 which extends from its front end 52 to near its rear end 54. Externally the member 42 has a front threaded part 56 and a rear threaded part 58 that has a cross-cut 60 for manipulating the inner member 42. A nut 62 (see FIG. 1) engages the end 60 to hold the nozzle unit 22 in position on the headers. A pair of peripheral grooves 64 are formed in the walls 36 and 38 to receive "O"-rings 66 that seal respectively against the inner member 42, a washer 67 being inserted between these grooves and "O"-rings.

Two bores 68 pass through the wall of the inner member 42 at its rear end and thus connect the interior of the header 12 to the conduit 50.

Flats 70 are formed on diametrically opposed sides of the inner member 42 from about the front third of its length at the interior of the header 14. The end face 72 of the inner member 42 is flat and smooth.

THE NOZZLE 46

The nozzle 46 has a hollow boss 74 that is engaged in the bore 24 with the interposition of an "O"-ring 76, a cylindrical body part 78 and a frusto-conical front part 80, the end face 82 of which is smooth and lies in a plane normal to the axis 46*a* of the nozzle 46.

The nozzle 46 has an internal threaded bore 84 which is stepped down at 85 to a smaller diameter bore 86 the rear end of which is internally screw threaded and which leads to yet a smaller diameter end outlet passage 88 that passes through the end face 82. The threaded front part 56 of the inner member 42 is threadedly received in the bore 86.

THE MIXING CHAMBER 44

The mixing chamber 44 is received loosely within the bore 86. It comprises a cylindrical member 92 having an inner end face 94 which butts against the end face 72 of the inner member 42 and an external step 96 that butts against the step 98 between the bore 86 and outlet passage 88.

Internally the mixing chamber 44 is formed with a passage 100 in the form of a venturi having a throat 102 of one millimeter diameter. Four narrow radial bores 104 extend from the periphery of the chamber 44 to enter the passage 100 slightly downstream of the throat 102 in the low pressure zone of the venturi. The term "low pressure zone" includes the throat of the venturi and adjacent downstream parts of the venturi as is known to those skilled in the art. The diameter of each of the bores 104 is preferably one half of the diameter of throat.

THE CAP 48 (FIGS. 3 and 5)

The cap 48 is an open ended hollow cylindrical member having an axial length of 5 mm, an outer diameter of 3 mm (which is one half the diameter of the outlet passage 88) and an internal diameter of 2 mm.

The cap 48 is carried by a pair of rigid, diametrically opposed triangular carriers 108 to be co-axially located relative to the nozzle 48 and with the mouth 110 of the cap 48 lying in a plane which is spaced by just under a millemetre from the plane containing the end face 82.

The nozzle 46, the cap 48 and the carriers 108 are machined from a single piece of metal. This is effected by first machining the outside of the nozzle part, then boring out the bores in the nozzle up to the cap and drilling the bore of the cap and thereafter milling out the material surrounding the cap and the carriers. In carying out the the milling operation, the milling bit will cut through the outlet passage 88 at the end of the cap 48. Finally all edges will be ground smooth.

OPERATION.

The headers 12 and 14 are connected respectively to sources of air and water under pressure. Consequently air will pass from the interior of the header 12 through the cross-bores 68 into the conduit 50 and to the venturi throat 100 of the mixing chamber 44. Also water under pressure will pass from the interior of the header 12 along the spaces defined within the nozzle bore 84 by the flats 70 until it enters the throat 102 via the radial bores 104. The air will entrain the water and escape through the end of the outlet passage 88 with the inner core of the water/air mixture being directed into the cap 48 where it strikes against the internal face of the cap 48. The water droplets will be broken down into a fine mist or "fog" and will be discharged from the mouth 110 of the cap and will be entrained by the surrounding tube of air/water mixture which by-passes the resonator cap 48 and then discharged into the atmosphere.

We have found that the nozzle unit as described above and illustrated in the drawings operating at conventional pressures of water (about 108–160 kPa) and air (about 450 kPa) will deliver 130 millimeters of water fog per minute. The nozzle unit provides a fog of extremely fine droplets that appear to be finer than those which have been obtained by hitherto known nozzles and the results of an independent test showed that the mean diameter of such of the droplets formed by this nozzle unit is 0.58 $m^{-6}$. It will be appreciated that this is of importance as the finer the droplet size, the finer the dust particles to which they will in use be attached and in addition the higher will be the amount of droplets per square millimeters at a predetermined distance from the jet (which is conventionally measured at three metres from the jet). Thus fewers nozzles will be required with such fine droplet size.

In addition, we have found that the header arrangement permits nozzle arrangements of any convenient length to be achieved so that the fog may be used to over a space as wide as may be necessary.

Reference is now made to FIG. 5 wherein is shown a nozzle unit 112 of the invention for producing a substantial amount of "fog" for cooling purposes and using approximately three litres of water per second. The nozzle unit 112 is intended to be mounted separately without the use of headers similar to headers 14 and 18 and separate pipe means are provided for supplying water and air under pressure.

The nozzle unit 112 comprises a body 114 formed from two parts 116 and 118 which are screw-threaded together. The body has a bore 120 having a smaller rear portion 122 and enlarged diameter central portion or chamber 124, a smaller diameter connecting portion 126 leading therefrom and finally a tapered reducing portion 128 which terminates in an outlet opening 130. A step 132 lying in a radial plane defines the rear end of the chamber 124. The outermost end of the rear portion 122 is screw-threaded to permit connection to a source of water under pressure. An adjacent bore 134 (the "air bore") is provided in the base of the member 116 with its axis parallel to the axis of the bore 120. The air bore 134 also has its outer portion screw-threaded. Thus the air bore 134 may be connected to a source of compressed air under pressure.

Within the chamber 124 there is received a tube 136 in which is formed a mixing chamber 138. The outer diameter of the tube 136 is less than that of the chamber 124 and the forward end 139 thereof has raised threads thereon which threadedly engage in threads cut into the rear end of the connecting portion 126. The axial length of the tube 136 is such that its rear end 140 lies flush with the radial surface or step 132 and forms a substantial seal therewith. Within the forward portion of the mixing chamber 138 there is a constriction 142 to form a venturi passage having a converging portion 144, a throat 146 and a diverging portion 148. Six radial bores 150 extend from the exterior of the mixing chamber 138 to the throat 146 of the venturi and thus in the low pressure area of the venturi.

The forward end 152 of the nozzle 112 is tapered and carries a cap 154 by means of a pair of robust carriers 156 in similar manner to the carriers 108 in the first embodiment. The diameter of the throat 146 is 12 mm and the spacing of the mouth 158 of the cap 154 to front end 160 of the nozzle 112 is 5 mm i.e. less than one half of the diameter of the throat.

The operation of the nozzle 112 is similar to that of the nozzle unit 22.

We have found that the rigid carriers hold the caps 48 and 154 against resonant oscillation. We believe that the nozzles provide so fine a fog because they operate on a high energy field between the venturi throat 102 and the cap 48 to shatter the water particles down to submicron size. This operation differs from prior nozzles known to us in which the cap oscillates so that the nozzle operates on a high frequency energy source.

Further we have found that the construction of the resonator caps 48 and 154 and the carriers 108 and 156 enable the nozzles to be more economically made and to be robust in use.

The invention is not limited to the precise constructional details hereinbefore described and illustrated in the drawings.

I claim:

1. A nozzle unit comprising
(a) a frusto-conical nozzle having
(i) a transverse flat end face,
(ii) an outlet passage formed in this flat end face,
(iii) an inner conduit member which in use is connected to a source of pneumatic pressure,
(iv) a water conduit which in use is connected to a source of water under pressure, and
(v) a mixing chamber having
(1) a venturi passage therethrough having a low pressure section including a venturi throat which venturi passage is connected to the said inner conduit member, and
(2) inlet bores from the exterior of the chamber to a low pressure section of the passage, the water in use being drawn through such bores to the interior of the said low pressure section of the venturi passage in which said low pressure section the water and air is mixed and from which the mixture passes to be discharged through the outlet passage,
(b) a concave cylindrical cap having an open mouth facing the outlet passage and into which the water-/air mixture is discharged, the water being there broken down into very small droplets, and
(c) carrier means secured to the nozzle and carrying the cap thereon,
wherein the mouth of the cap is spaced from the said end face by no more than one-half of the diameter of the throat of the venturi.

2. A spray nozzle unit as claimed in claim 1 wherein the mouth of the cap is located close to end face.

3. A spray nozzle unit as claimed in claim 1 wherein the outer diameter of the cap is about one half the diameter of the outlet passage.

4. A nozzle arrangement comprising a pair of headers and at least one nozzle unit as claimed in claim 1 carried thereby; the headers being connectable respectively to sources of water and pneumatic pressure and being connected respectively to the inner and air conduits.

5. A nozzle arrangement as claimed in claim 4 wherein the headers are adapted to be connected to similar headers to build up a nozzle system of desired length.

6. A nozzle arrangement as claimed in claim 4 comprising two nozzle units.

7. A nozzle arrangement as claimed in claim 4 wherein the nozzle units are located at the ends of one of the headers.

8. A nozzle unit comprising
(a) a frusto-conical nozzle having
(i) a transverse flat end face;
(ii) an outlet passage formed in the flat end face;
(iii) an inner conduit member which in use is connected to a source of pneumatic pressure;
(iv) a water conduit which in use is connected to a source of water under pressure; and
(v) a mixing chamber having
(1) a venturi passage therethrough having a low pressure section including a venturi throat which venturi passage is connected to the said inner conduit member, and
(2) inlet bores extending from the exterior of the chamber to the low pressure section of the passage, the inlet bores being connected to the water conduit;
(b) a concave cylindrical cap having
(i) an open mouth facing the outlet passage, the mouth being spaced from the end face by no more than one-half of the diameter of the throat of the venturi; and
(ii) an outer diameter which is less than the diameter of the outlet passage; and
(c) carrier means integral with the nozzle and the cap and carrying the cap on the nozzle.

9. The combination of first and second headers with a nozzle unit wherein
A. the first header is connectable to a source of water pressure;
B. the second header is located parallel and close to the first header and being connectable to a source of pneumatic pressure;
C. the nozzle unit is carried by the said first header and comprises
(a) a frusto-conical nozzle having
(i) a transverse flat end face;
(ii) an outlet passage formed in this flat end face; and
(iii) a mixing chamber having
(1) a venturi passage therethrough having a low pressure section including a throat, and
(2) inlet bores from the exterior of the chamber to a low pressure section of the passage, the inlet bores being connected to the first header,
(b) an inner conduit member passing through both the headers and having
(1) a bore therethrough with one end connected to the venturi passage and having the other end closed, and
(2) apertures opening from its bore into the said second header,
(c) a nut on the end of the inner conduit member at its end remote from the nozzle to hold it to the headers;
(d) a concave cylindrical cap into which the water-/air mixture is discharged, the water being there broken down into very small droplets, the cap having an open mouth facing the outlet passage and being arranged with the mouth spaced from the end face by no more than one-half of the diameter of the throat of the venturi; and
(e) carrier means secured to the nozzle and carrying the cap thereon.

10. The combination of claim 9 in which the inner conduit member is sealed to the headers by "O"-ring seals where the inner conduit member passes through the headers.

11. A spray nozzle unit as claimed in claim 8 wherein the outer diameter of the cap is about one half the diameter of the passage.

* * * * *